US006209428B1

(12) United States Patent
Anderson et al.

(10) Patent No.: US 6,209,428 B1
(45) **Date of Patent: *Apr. 3, 2001**

(54) COMPLETE HAND TOOL SET IN ONE HAND TOOL

(76) Inventors: Wayne Anderson, 65 Grove St.; Paolo Cassutti, 8 N. Creek Rd., both of Northport, NY (US) 11768

( * ) Notice: Subject to any disclaimer, the term of this patent is extended or adjusted under 35 U.S.C. 154(b) by 0 days.

This patent is subject to a terminal disclaimer.

(21) Appl. No.: 09/168,637

(22) Filed: Oct. 8, 1998

Related U.S. Application Data

(63) Continuation-in-part of application No. 08/977,453, filed on Nov. 24, 1997, now Pat. No. 5,904,080, which is a continuation of application No. 08/620,471, filed on Mar. 22, 1996, now abandoned, and a continuation-in-part of application No. 08/960,090, filed on Oct. 24, 1997, now Pat. No. 5,819,612, which is a continuation of application No. 08/608,195, filed on Feb. 28, 1996, now abandoned, and a continuation-in-part of application No. 08/846,070, filed on Apr. 25, 1997, now Pat. No. 5,868,048.

(51) Int. Cl.[7] ..... B25G 1/08

(52) U.S. Cl. ..... 81/490; 81/177.4; 81/439

(58) Field of Search ..... 81/177.4, 438, 81/439, 490

(56) References Cited

U.S. PATENT DOCUMENTS

| | | | | |
|---|---|---|---|---|
| 4,096,896 | * | 6/1978 | Egel | 81/177.4 X |
| 4,924,733 | * | 5/1990 | McKenzie | 81/490 X |
| 5,533,429 | * | 7/1996 | Kozak | 81/439 |
| 5,819,612 | * | 10/1998 | Anderson | 81/490 |
| 5,868,048 | * | 2/1999 | Cassutti et al. | 81/490 X |
| 5,894,765 | * | 4/1999 | Anderson et al. | 81/490 X |
| 5,904,080 | * | 5/1999 | Anderson et al. | 81/439 |

* cited by examiner

*Primary Examiner*—James G. Smith
(74) *Attorney, Agent, or Firm*—Lackenbach Siegel Marzullo Aronson & Greenspan

(57) ABSTRACT

An essentially complete screwdriver set or tool bit drive set is encompassed in a single hand tool with an ergonomic handle. Upwards of 26 different tool bit drives in combination with multiple hex nut drives are readily interchangeably used in the hand tool. The ergonomic handle is of partible molded clear plastic so that diverse color-coded tool bit drives are readily recognized and retrieved.

13 Claims, 6 Drawing Sheets

65
65
66
68
67
75
76
45
45
57
61
56
55
35
56
55
58
57
56
58
45
14
28
10
14
31
19
32
11
25
27
44
40
45a
42
34
41
43
24
45
45b
25
24
45b

COMPLETE HAND TOOL SET IN ONE HAND TOOL

PRIOR RELATED APPLICATIONS

This application is a continuation-in-part application of Ser. No.08/977,453, filed Nov. 24, 1997, now U.S. Pat. No. 5,904,080, issued May 18, 1999, which is a continuation of Ser. No. 08/620,471, filed Mar. 22, 1996 now abandoned, and a continuation-in-part application of Ser. No. 08/960, 090, filed Oct. 24, 1997, now U.S. Pat. No. 5,819,612, issued Oct. 13, 1998, which was a continuation of Ser. No. 08/608, 195, filed Feb. 28, 1996, now abandoned, and a continuation-in-part application of Ser. No. 08/846,070, filed Apr. 25, 1997, now U.S. Pat. No. 5,868,048, issued Feb. 9, 1999.

FIELD OF THE INVENTION

This invention relates to hand tools. Specifically this invention relates to a hand tool particularly wherein a high number of hand tool functions are provided in one hand tool.

BACKGROUND OF THE INVENTION

The hand tool art traditionally provided tool sets, such as screwdriver sets and socket wrench sets. These sets were comprised of multiple hand tools to accomplish different tool bit drive functions as well as to accomplish differently sized similar tool bit drive functions.

Prior art commercial screwdriver sets would, by way of example, include from eight (8) to twenty-two (22) screwdrivers or separately housed tool bit drives, as shown in attached FIGS. 1 and 2, respectively. Socket wrench sets and tool bit drive sets required specialized mounting and storage for the large pluralities of socket drives and tool bit drives.

The art desired multiple tool bit drive combination tools to reduce the mounting and storage requirements. Rocca, U.S. Pat. No. 4,448,097 granted May 15, 1994, disclosed a complex multiple piece housing construction which provided a total of six (6) tool bit drive functions and two (2) nut drive means functions. Kozak, U.S. Pat. No. 5,450,775 granted Sep. 19, 1995, disclosed a multiple tool bit drive function of complex housing design. These early attempts achieved some limited multiple functionality in a hand tool, and required complex construction. The hand tool art however ultimately desired a single hand tool which contained essentially an entire or complete screwdriver set or tool bit drive hand tool set. The prior art fell far short of that need.

SUMMARY OF THE INVENTION

This invention in one broad aspect is a single hand tool which operably contains a complete screwdriver or multiple tool bit drive hand tool set. In another aspect, this invention is one hand tool which integrally contains upwards of 26 different tool bit drives in combination with multiple hex nut drives, which tool bit drives and hex nut drives are readily interchangeably used in the one hand tool.

The hand tool of the present invention provides an ergonomic handle design to house a maximized number of tool bit drives and hex nut drives. The handle in combination with a removable multiple tool bit drive shank provides a full complement of tool bit drives.

In another aspect, the present invention provides, in further combination with the aforesaid, a clear plastic ergonomic handle which permits ready viewing of and access to the tool bit drives within the handle. The tool bits may be color coded as to both size and function for viewing through the clear plastic handle for ready identification and access.

The hand tool of the present invention provides essentially a complete tool set to the user. The hand tool is of practical and safe design and construction, and readily manufactured by means known to those skilled in the art.

DESCRIPTION OF THE INVENTION

Figure 1:
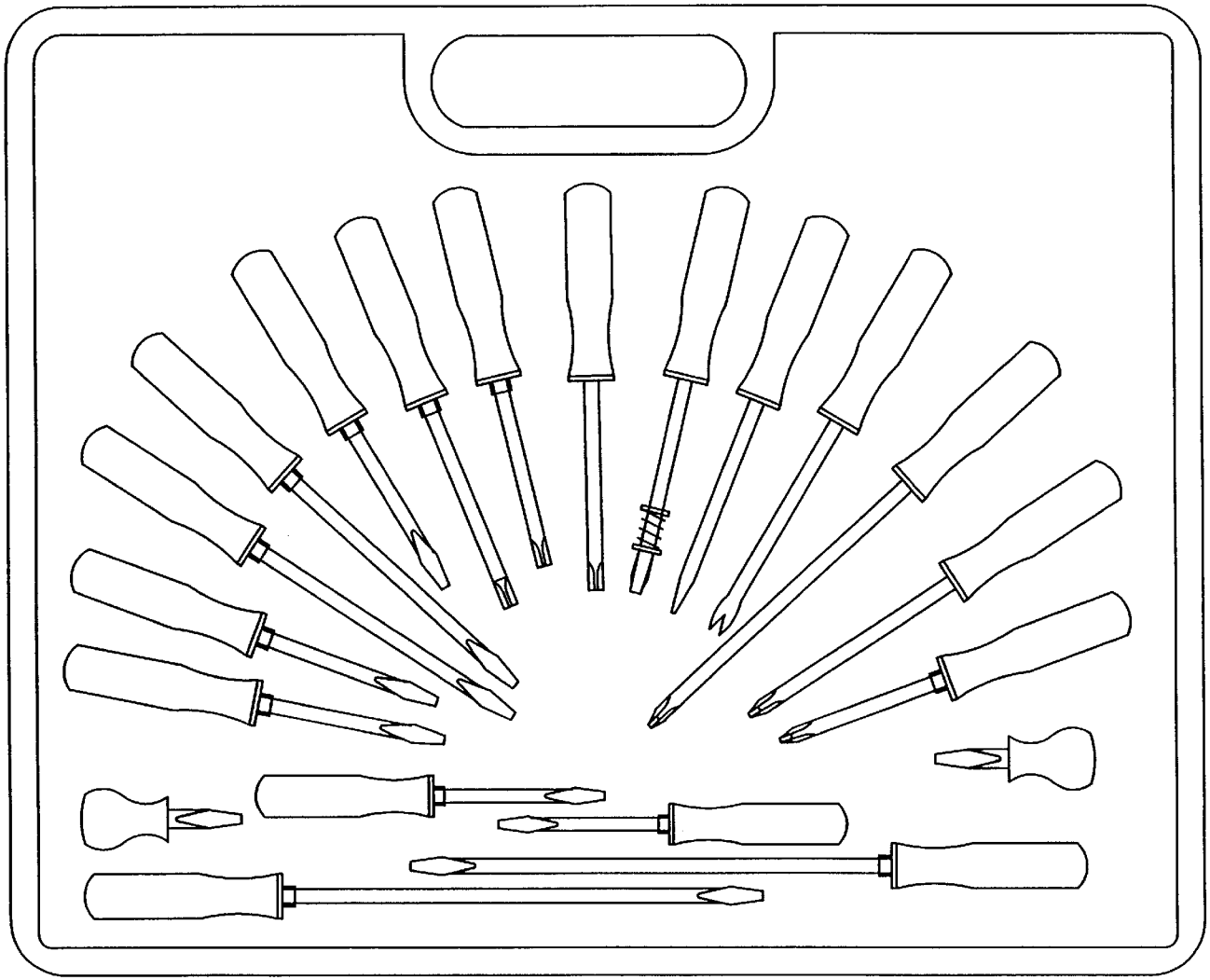
FIG. 1 PRIOR ART
FIG. 1 is a front elevational reduced scale view of a clear display package containing a prior art 22 piece hand tool set.
Figure 2:
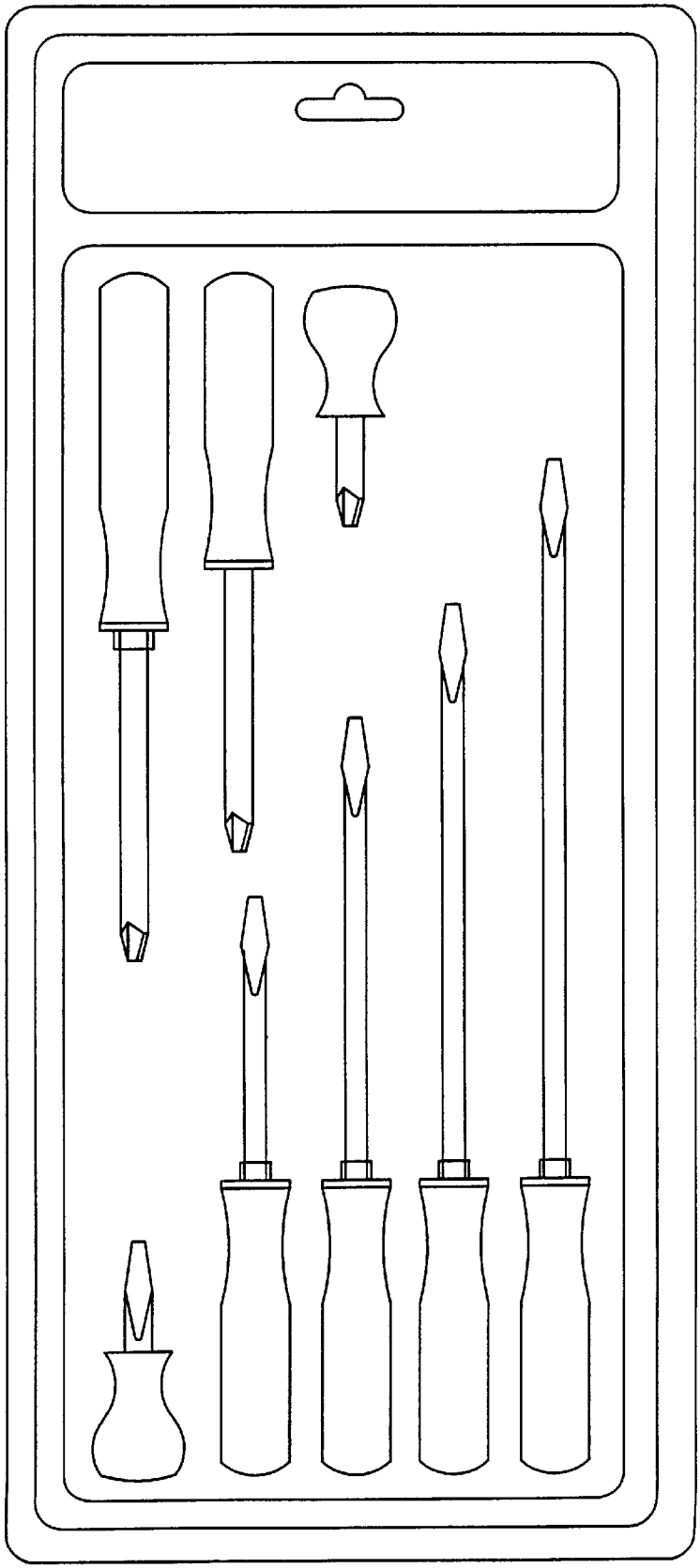
FIG.2 PRIOR ART
FIG. 2 is a front elevational reduced scale view of a clear display package containing a prior art 8 piece screwdriver set.

Referring to FIGS. 3–6, there is shown the hand tool 10 of the present invention. Hand tool 10 is formed of a clear plastic handle body 11. Handle body 11 is formed with a generally rectilinear cross-section with four rounded corners 12 (typical). Handle body 11 is of a size and shape to be conventionally gripped by the user, and yet ergonomically provides maximized multiple tool bit drive storage within the handle, as will be more fully explained hereinafter.

Handle body 11 is formed with a central elongated cylindrical compartment or through hole 13 and four immediately adjacent elongated non-central cylindrical compartments 14 (typical). Each compartment 14 is similarly sized, but of lesser cross-dimension or diameter than central compartment 13. Each compartment 14 is juxtaposed to a respective handle body portion corner 12, and each compartment 14 is contiguous with and to central compartment 13. This ergonomic design, construction and arrangement maximizes handle storage capability while minimizing the overall size or cross-dimension of the handle so as to provide conventional gripping by the user. Further discussion of a similar ergonomic handle design and construction is disclosed in U.S. Ser. No. 08/960,090, filed Oct. 24, 1997, now U.S. Pat. No. 5,819,612, granted Oct. 13, 1998, which disclosure is fully incorporated herein by reference thereto.

Each non-central compartment 14 is formed with a bottom wall 16 and side wall 17, for purposes hereinafter appearing. Handle body portion 11 is formed at its proximate end 18 with a peripheral lip 19, and at its distal end 20 with receiving recess 21 formed in central compartment 13, as further discussed and for purposes hereinafter appearing.

Figures 3, 3A, 3B:
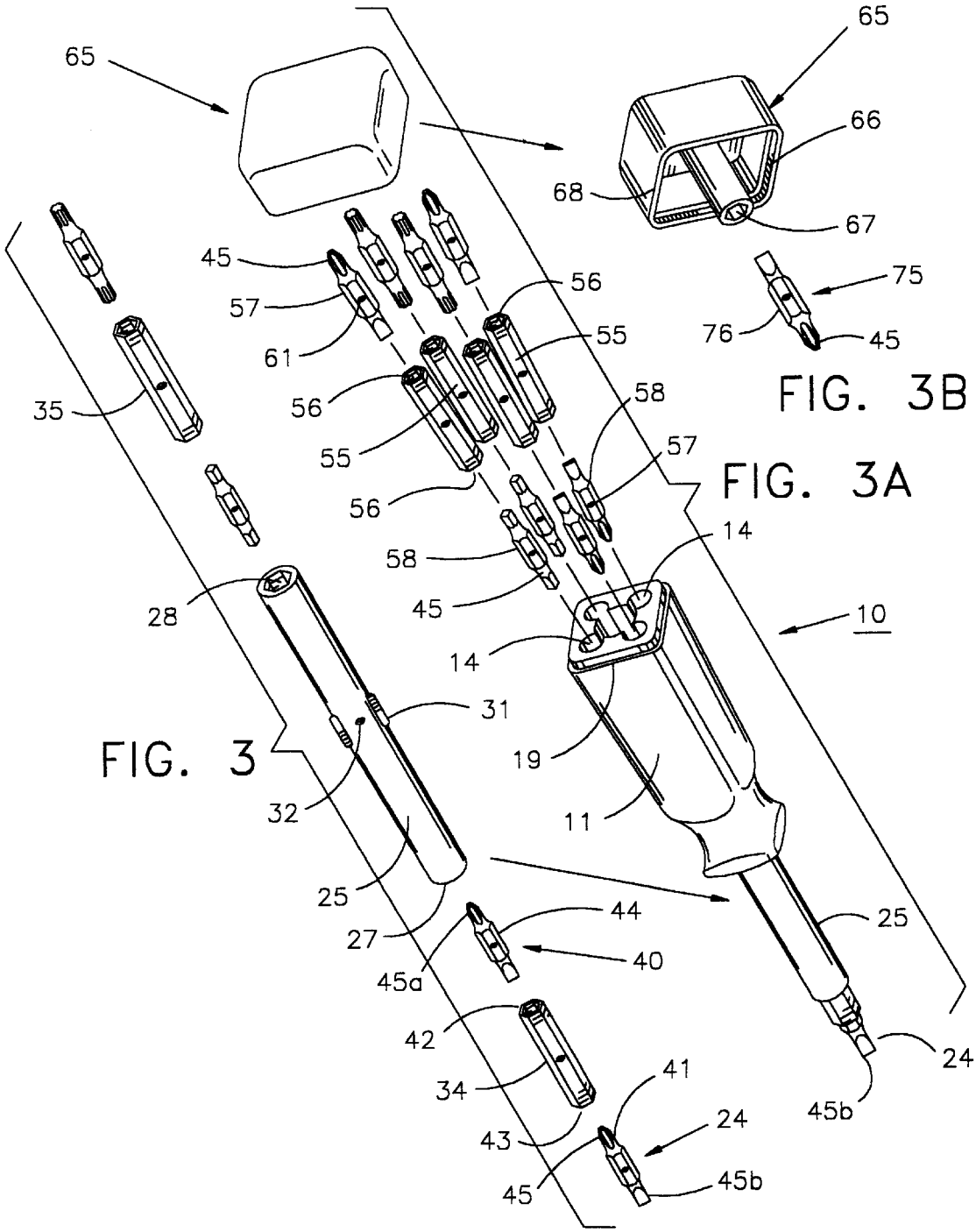
FIG. 3 is a perspective partial exploded view of a hand tool of the present invention.
FIG. 3A is an enlarged perspective exploded view of the eight-in-one tool bit drive assembly, portion of the tool of FIG. 3.
FIG. 3B is a reverse perspective exploded view of the tool handle cap of the hand tool of FIG. 3.
Figure 4:
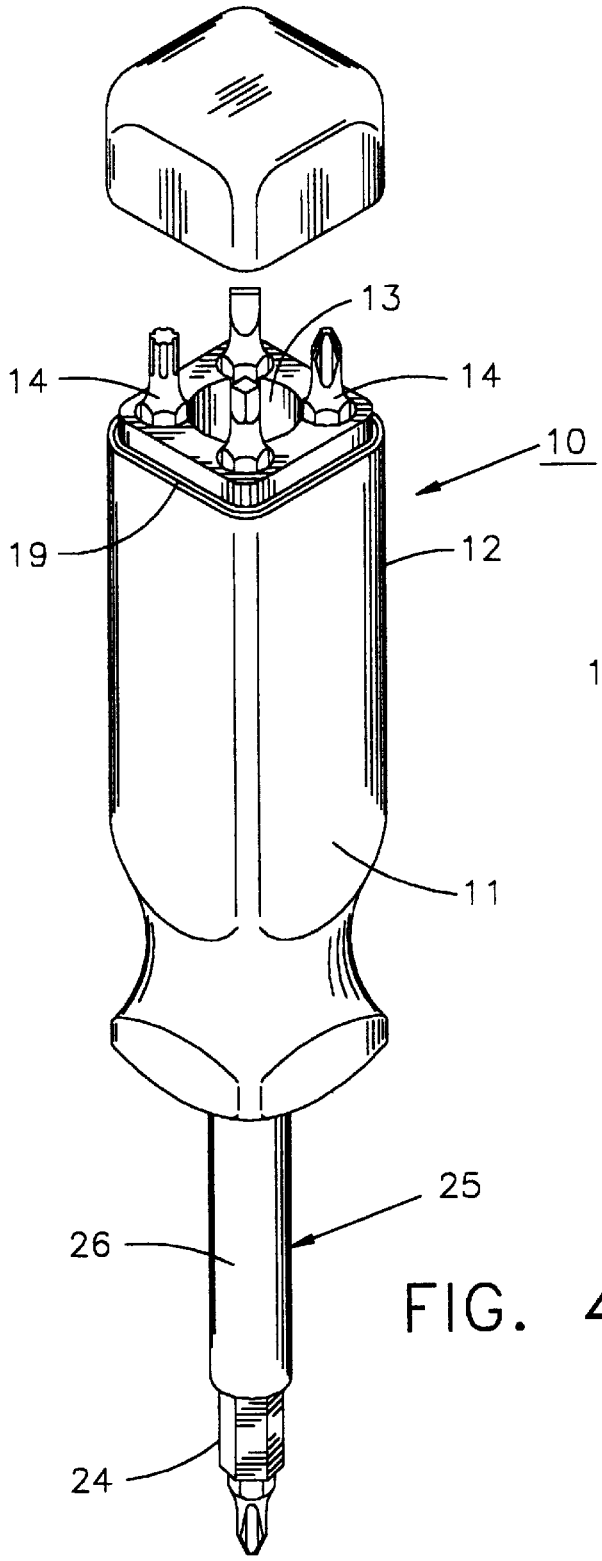
FIG. 4 is a front perspective partial assembly view of the hand tool of FIG. 3.
Figure 5:
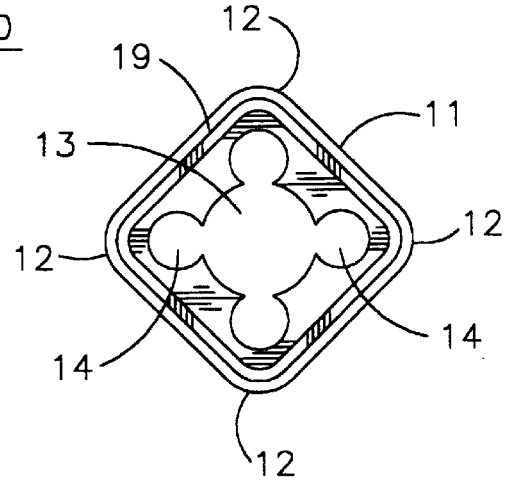
FIG. 5 is a top plan view of the hand tool of FIG. 3 with the handle cap and tool bit drives removed.
Figure 7:
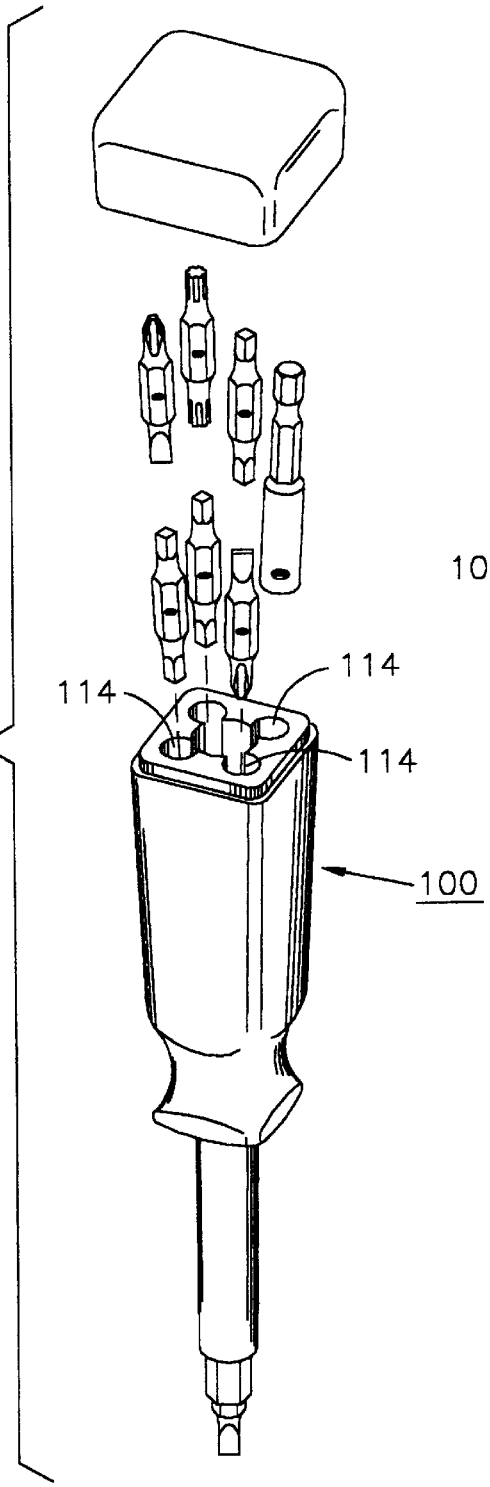
FIG. 7 is a perspective partial exploded view of another hand tool embodiment.

A shank housing 25 of unitary cold heading construction is provided to store and retain diverse tool bits and to provide a functional tool bit drive at distal end 24 for hand tool 10, as best shown in FIGS. 3–3*a*. Housing 25 is formed of elongated tubular construction with a cylindrical outer surface 26 and oppositely disposed inner hexagonal cavities 27 and 28 and a solid central wall 89 having oppositely facing hexagonal wall portions 29 and 30 forming the bottoms or end walls of cavities 27 and 28, respectively (FIG. 7). Cylindrical surface 26 is formed with oppositely disposed ears 31 and oppositely disposed detents 32. Housing 25 is sized to be slidably retained in recess 21 of central compartment 13, with ears 31 retained in recesses 33, with detents 32 seated in handle indents (not shown). By the immediately aforesaid construction, shank housing 25 is non-rotatably operably retained in the handle body portion 11.

Two hexagonal tool bit drive housings 34 and 35 are of unitary construction and sized to be slidably received in the respective shank housing cavities 27 and 28. Each hexagonal housing 34 and 35 is sized to be received in one or both of the shank housing cavities 27 and 28. Two (2), tool bit drive members 40 and 41 are provided to be retained in the respective hexagonal cavities 42 and 43 for housing 34 sub-assembly. Each member 40 and 41 is formed with a hexagonal body portion 44 and opposed tool bit drives 45 (typical) disposed at opposite ends of the body portion. It is understood that the tool bit drives 45, disclosed herein are of different size and/or configuration to provide upwards of 26 different tool bit drives in the entire tool 10. By way of example, tool bit 45*a* is a Phillips head screw drive and tool bit 45*b* is a slotted head screw drive. Housing 35 has a similar sub-assembly. That is, housings 39 and 35 are formed of unitary construction and provided with inner hexagonal cavities for receiving two tool bit members with respective tool bit drives 45.

The hexagonal housings 34 and 35 with the tool bit drive members 40 and 41 and tool bit drives 45 are assembled and in turn assembled into shank housing 25 which in turn is slidably assembled to the handle body portion central compartment 13 to provide an 8-in-1 sub-component tool bit drive construction. A similar 8-in-1 tool bit drive construction is further shown and described in U.S. Ser. No. 08/977,453, filed Nov. 24, 1997, which disclosure is fully incorporated herein by reference thereto.

Figure 6:
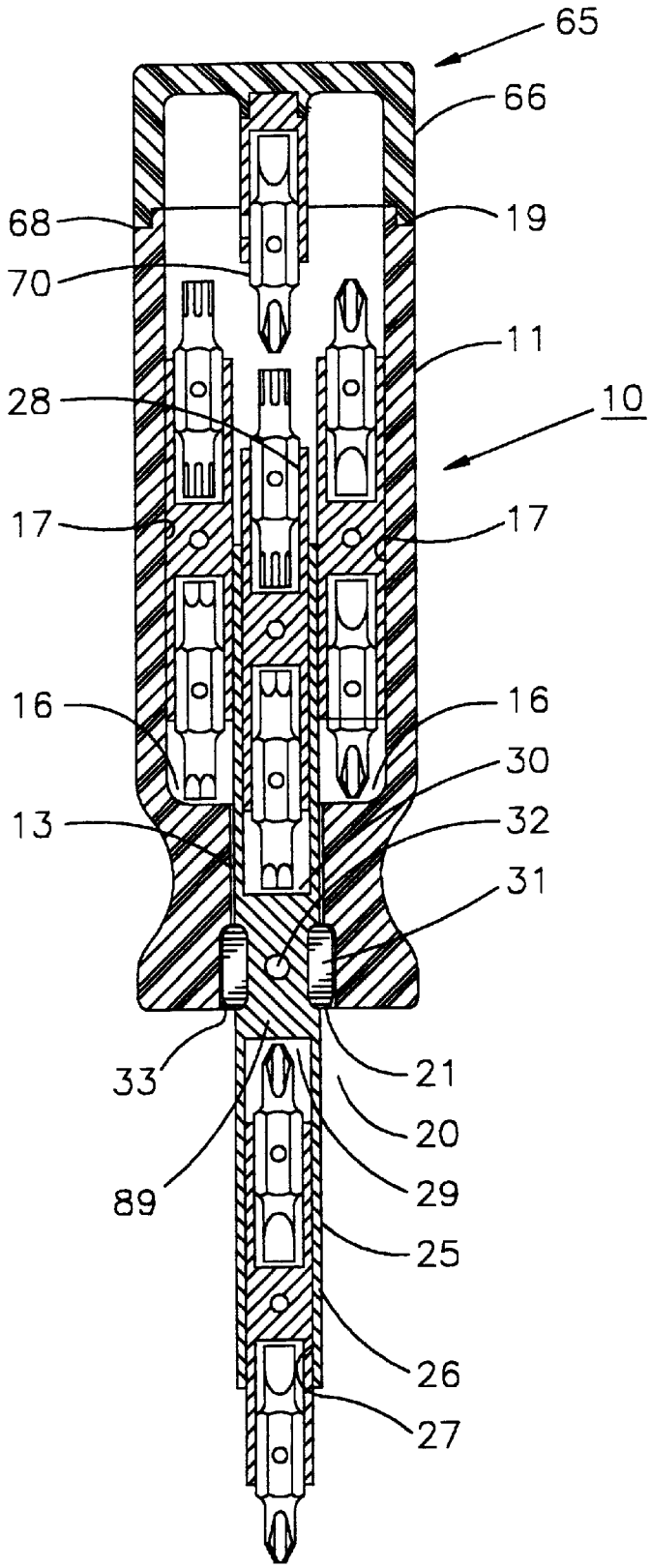
FIG. 6 is a half longitudinal sectional view taken of the hand tool of FIG. 4 with the handle cap on the hand tool.

Referring specifically to FIGS. 3 and 6, there is shown a set of four similarly sized hexagonal housings 55, formed of unitary cold heading construction forming separated oppositely disposed hexagonal cavities 56. Each of eight (8) tool bit drive members 57 (typical) is formed with a hexagonal coupling body portion 58 formed with two oppositely disposed tool bit drives 45, similar to those afore-described. Tool bit drive member 57 hexagonal body portion 58 is sized for slidable retention in cavities 56.

It is important to note that there are heretofore disclosed twelve (12) tool bit drive members providing a total of twenty-four (24) tool bit drives 45. As previously stated, each tool bit drive 45 may be of a different size and/or configuration and/or function from the other so as to provide up to twenty-four (24) different tool bit drive combination functions within the sub-component handle body 11 and sub-component shank housing 25 combination assembly. It is also important to note that the hexagonal sizes of the inner cavities of the shank housing 25 may be differently cross-dimensional from the hexagonal inner cavities 56 of the handle body housings 55 so as to provide a plurality of hex nut drives in addition to the plurality of tool bit drives.

Referring now to FIGS. 3, 3*b* and 6, there is shown a generally rectilinear tool handle cap or proximate cap portion 65. Cap 65 is formed with a generally clear molded plastic body portion 66 and a metal insert 67 fixedly attached or molded to plastic portion 66. Insert 67 is attached by crimping, force fitting, insert molding or other means well known to those skilled in the art. Portion 66 is formed with a peripheral lip 68 which releasably clips or seats onto handle body portion lip19 (FIG. 7). Insert 67 is formed with a cylindrical outer surface 69 and an inner hexagonal recess or cavity 70. Hexagonal cavity 70 may be of a different size than the heretofore discussed hexagonal cavities to provide a still larger plurality of available hex nut drives for tool 10. A tool bit assembly 75 is provided with a hexagonal coupling body portion 76 formed with two (2) oppositely disposed tool bit drives 45. Assembly 75 is slidably retained in cavity 70 by means previously discussed. The combination of tool bit assembly 75 with_ cap 65 provides an awl type hand tool. The user holds cap 65 with assembly 75 engaged to the cap to provide a separate tool or awl-type hand tool.

Cap 65 when assembled to the handle body 11 provides by interchanging twenty-six (26) tool bit drive functions in the hand tool 10. That is, eight (8) tool bit drives are housed in sub-component shank housing 25, and sixteen (16) tool bit drives 45 are housed in sub-component 55 within handle body 11. And as best shown in FIGS. 3, 3A, 3B and 6, hand tool 10 in its complete assembly provides thirteen (13) tool bit drive assemblies in turn providing twenty-six (26) tool bit drive functions and a plurality of hex nut drive functions.

Figure 7A:
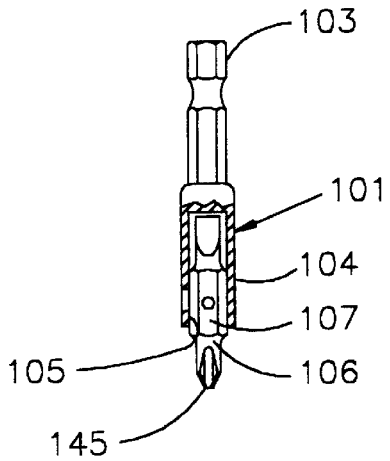
FIG. 7A is an enlarged partial sectional view of the replacement bit chuck assembly component of the hand tool of FIG. 7.

Referring now specifically to FIGS. 7 and 7A, there is shown an alternate embodiment 100. Embodiment 100 is similar to embodiment 10, except that a tool chuck shank assembly 101 is provided in lieu of one of the aforementioned hexagonal tool bit drive assemblies. Shank assembly 101 is sized to be housed one of the non-central handle body compartments 114. Assembly 101 is formed at its proximate end 102 with a hexagonal shank 103 of conventional configuration for assembly to, by way of example, a hand power tool (not shown). Assembly 101 at its distal end 104 is formed with a inner hexagonal cavity 105 sized to receive tool bit member 106 with mating hexagon coupling body portion 107, and having opposed tool bit drives 45 which tool bit drives 45 are similar to those described in connection with embodiment 10. In operation, assembly 101 is removed from a non-central compartment 114 in handle body portion, 111 and then the proximate end 102 of the shank is assembled to a chuck (not shown) hand power tool to drive the tool bit drive 145 disposed at distal end 104.

The handle body 11 and handle cap portion 66 may preferably be of clear molded plastic construction. This clear handle construction permits the user to first view the diverse tool bit drives to determine the exact location of the particularly desired tool bit drive. The user then removes the cap portion 66, and removes the hexagonal tool bit drive assembly that contains the desired tool bit drive. Additionally, the tool bit drives may be color coded as to both size and function to assist the user in readily determining the location of the desired tool bit drive in the handle. By way of example, the tool bit drive may have one color dot or encompassing color band that signifies size and another differently color dot or encompassing band that signifies function, which dots or bands would be readily viewed through the clear handle. Color coding schemes for the tool bit drives are well known in the art.

While the foregoing has disclosed certain preferred embodiments of the invention it will be obvious to those skilled in the art that various modifications and changes may be made within the spirit and scope of the invention as set forth in the adjoined claims.

What is claimed is:

1. A hand tool comprising; a handle, said handle comprising a plurality of elongated radially disposed compartments for storing a first plurality of tool bits and a shank for retaining a second plurality of tool bits and being formed with oppositely disposed cavities, each said cavity comprising means for retaining one of said second plurality of tool bits, and said handle having a central compartment being sized to slidably receive said shank, said central compartment being formed for storing at least one additional tool bit, whereby with the shank assembled in the handle central compartment said first and second pluralities of tool bits are housed in the hand tool.

2. The hand tool of claim 1, said central and said elongated compartments being contiguous.

3. The hand tool of claim 1, wherein said central compartment is axially disposed with respect to each of said elongated compartments.

4. The hand tool of claim 3, said central and said elongated compartments being contiguous.

5. The hand tool of claim 1, said handle further comprising an essentially non-circular cross-section, having 4 corners and 4 respective said elongated compartments contiguous with said central compartment, and each of said 4 elongated compartments being disposed adjacent a respective said corner.

6. The hand tool of claim 1, said handle comprising a body portion and a cap portion, and further comprising means for removably holding the cap portion on the body portion, and wherein the elongated compartments are disposed in the body portion.

7. The hand tool of claim 6, said cap portion comprising means for operably retaining a tool bit whereby with the cap portion removed, the cap portion and the retained tool bit comprise a second hand tool.

8. The hand tool of claim 1, said handle comprising clear plastic construction for viewing the tool bits in the handle.

9. The hand tool of claim 1, said compartments comprising cylindrical compartments, and wherein the central compartment is of larger diameter than the said other compartments.

10. A complete hand tool set in one hand tool comprising:

a handle;

a shank;

said handle being formed with recess means for slidably removably holding the shank;

24 interchangeable tool bits;

said shank comprising a first plurality of sleeve means for removably holding 8 of said 24 tool bits in said shank;

said handle comprising a second plurality of sleeve means for removably holding 16 of said 24 tool bits in said handle;

wherein the hand tool is a 24-in-1 tool bit driver.

11. The hand tool of claim 10, further comprising a handle cap, said handle further comprising a central compartment, said handle cap and said central compartment comprising means for removably holding a third plurality of at least 2 tool bits, so as to provide a 26-in-1 tool bit driver.

12. The hand tool of claim 10, said first said sleeve means being slidably removable from said shank.

13. The hand tool of claim 10, said second said sleeve means being slidably removable from said handle.

* * * * *